United States Patent [19]

Finneran

[11] Patent Number: 5,016,771

[45] Date of Patent: May 21, 1991

[54] CAP CLOSURE AND LINER

[75] Inventor: James G. Finneran, Vineland, N.J.

[73] Assignee: J. G. Finneran Associates, Vineland, N.J.

[21] Appl. No.: 577,270

[22] Filed: Sep. 4, 1990

[51] Int. Cl.[5] ..... B65D 41/20

[52] U.S. Cl. ..... 215/341; 215/247; 215/DIG. 3

[58] Field of Search ..... 215/247, 341, 350, DIG. 3, 215/274, 275, 364, 356

[56] References Cited

U.S. PATENT DOCUMENTS

| | | | |
|---|---|---|---|
| 2,135,386 | 11/1938 | Crabbe | 215/247 |
| 2,748,967 | 6/1956 | Roach . | |
| 3,088,615 | 5/1963 | Mumford et al. . | |
| 3,232,471 | 2/1966 | Prothe | 215/350 |
| 3,709,395 | 1/1973 | Brennan et al. . | |
| 3,904,059 | 9/1975 | Bellamy, Jr. et al. . | |
| 4,187,149 | 2/1980 | Tolbert et al. . | |
| 4,205,754 | 6/1980 | Nielson et al. . | |
| 4,366,912 | 1/1983 | Matukura et al. . | |
| 4,416,661 | 11/1983 | Norman et al. | 215/247 |
| 4,482,069 | 11/1984 | Stadler . | |
| 4,664,275 | 5/1987 | Kasai et al. | 215/247 |
| 4,773,552 | 9/1988 | Boege et al. | 215/247 |

*Primary Examiner*—Stephen Marcus
*Assistant Examiner*—Paul Schwarz
*Attorney, Agent, or Firm*—Ratner & Prestia

[57] ABSTRACT

A cap closure having a top member with a center opening, a dependent skirt and a liner. The liner has a central raised portion, which may be concave, which mates with the center opening in the top member by an interference fit, thus retaining the liner in the center opening and under the top member.

3 Claims, 3 Drawing Sheets

CAP CLOSURE AND LINER

FIELD OF THE INVENTION

The invention relates to caps for bottles or containers, especially caps for laboratory sample bottles and dispensers containing pharmaceuticals and medicinal agents, which include a penetrable segment for introduction or withdrawal of material from a container on which the cap is mounted. This type of container requires a securely sealed cap which allows quick and easy access to the container contents.

BACKGROUND

Some conventional cap closures for sealing bottles include a liner over the mouth of the bottle, and a cap with a central opening which covers the liner and engages the neck finish of the bottle. Known specific examples are discussed below.

Boege et al., in U.S. Pat. No. 4,773,552, disclose a closure for sample bottles in which a plurality of disks fit into a metal cap having a center hole. The disks are retained in the cap by prongs around the periphery of the disks which are frictionally fit to the inside skirt of the cap. One of the disks is a liner which does not protrude into the hole in the cap.

Other typical cap closures include a liner/stopper combination which fits into a hole in the cap, and is frictionally retained there. The stopper completely fills the hole in the cap such that the top of the stopper and the top of the cap form the outer surface of the cap. In time, these liners tend to be released from the surrounding cap, particularly when the surrounding cap is a non-resilient material, such as poly-propylene.

Brennan et al., in U.S. Pat. No. 3,709,395, disclose a container closure including a liner—top of the cap—liner sandwich, wherein the liners are attached by a stopper through a hole in the cap.

BRIEF DESCRIPTION OF THE INVENTION

In the present invention, there is provided a cap closure including a top member with a center opening, a dependent skirt and a liner with a central raised portion which fits into the center opening of the top member. The sidewalls of the center opening and the liner raised portion are adapted to mate with one another, so that the central raised portion of the liner is retained in the center opening of the top member by an interference fit, thus holding the liner under the top member. The central raised portion may also be concave. The height of the liner raised portion should be no greater than that of the central opening in the cap to minimize contamination and to provide a combination which is relatively easy to assemble but is nevertheless secure from inadvertent mechanical dislodgement of the assembled components.

DETAILED DESCRIPTION OF THE INVENTION

The present invention is a cap closure comprising a top member, having a center opening, a dependent skirt and a liner.

Figure 1:
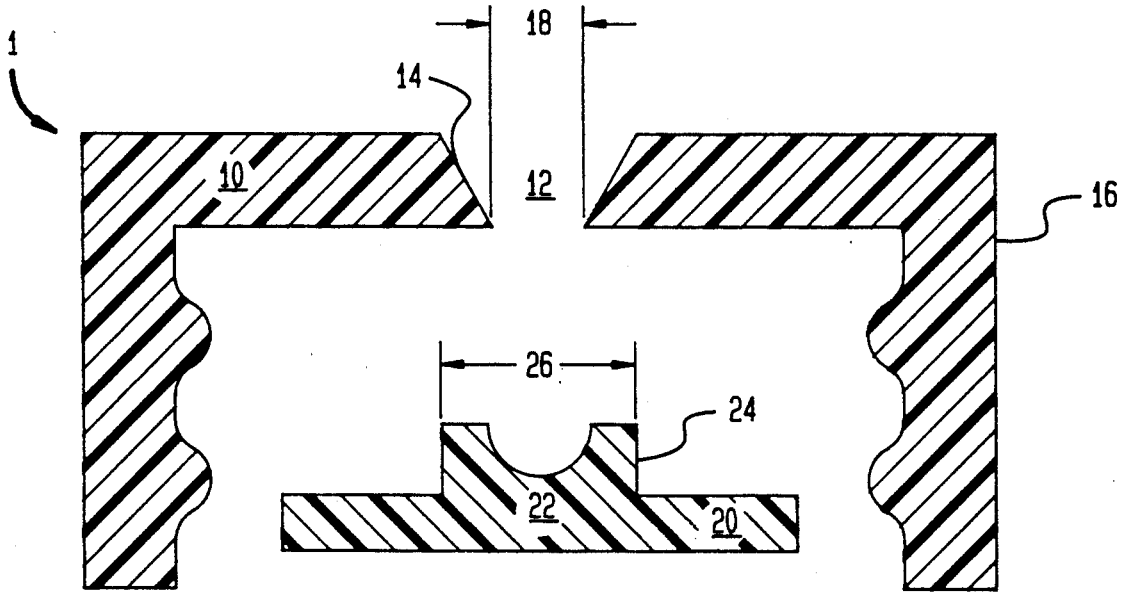
FIG. 1 is a cross-sectional view of the cap closure and liner assembly of the claimed invention.
Figure 2:
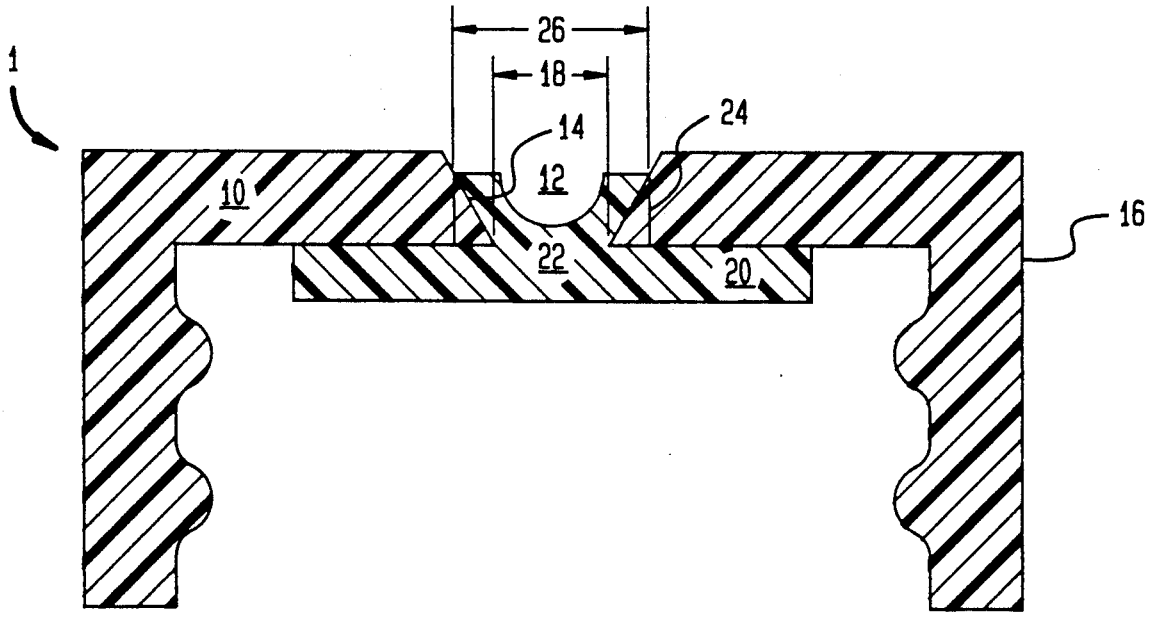
FIG. 2 is a cross-sectional view of one embodiment of the disassembled cap closure and liner of the claimed invention.
Figure 3:
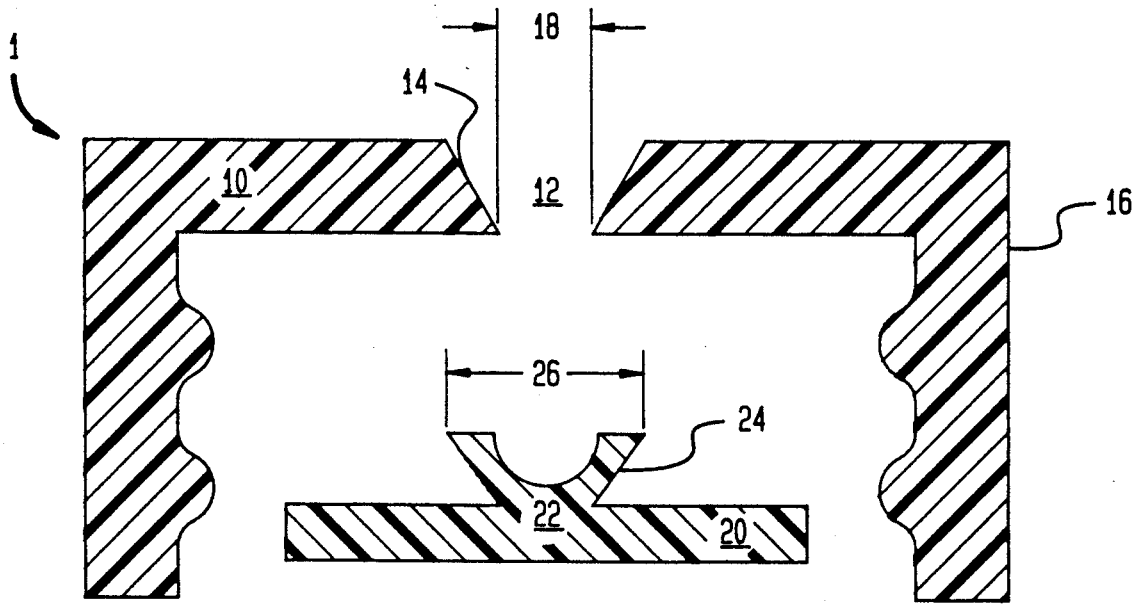
FIG. 3 is a cross-sectional view of one embodiment of the disassembled cap closure and linear of the claimed invention.

As shown in FIGS. 1, 2 and 3, top member 10 of cap 1 includes a center opening 12 surrounded by opening sidewall 14, which flares outwardly from a reduced diameter 18 at the lower or inner surface of top member 10 to an enlarged central raised portion diameter 26 at the top or outer surface thereof.

Cap 1 also includes dependent skirt 16, integral with and extending from top member 10. Skirt 16 is adapted to engage the neck finish of a container or bottle, usually by threads or snap rings (not shown). Top member 10 and dependent skirt 16 are typically composed of non-resilient material.

Liner 20 underlies top member 10 and is composed of a resilient material, silicone rubber for example. The resilient material facilitates puncturing with a needle or syringe and resealing of liner 20 such that liner 20 will self-repair a hole formed by such a needle or syringe. Liner 20 includes central raised portion 22 on its top or outer surface With a central raised portion sidewall 24. Thus, central raised portion diameter 26 is surrounded by central raised portion sidewall 24. Sidewall 24 may be straight (as shown in FIG. 1) or have a slight outward flare (as shown in FIG. 3) corresponding or nearly corresponding to that of center opening sidewall 14 to facilitate mating there between.

Central raised portion 22 mates with center opening 12 of top member 10 and, upon deformation of portion 22, forms to some degree mating frusto-conical segments (as shown in FIG. 2). Center opening 12 compresses central raised portion 22 such that central raised portion sidewall 24 assumes the outward flare of opening sidewall 14. The diameter 26 of central raised portion 22 is, at least at one point, greater than the smallest center opening diameter 18. The deformation compression of sidewall 24 provides a mechanical lock, or interference fit, between liner 20 and top member 10. Thus, central raised portion 22 of liner 20 is retained in center opening 12 by an interference fit. Accordingly, the interference mating prevents liner 20 from falling out of top member 10.

The dimensions of the cap closure are of particular importance to ensure an interference fit. To best accomplish this, the diameters of center opening 12 and central raised portion of liner 20 are controlled, preferably to five thousandths of an inch. Further, the outward flare of the mating sidewalls is generally in the range of 15 to 30 degrees from vertical, preferably about 20 degrees.

Preferably also, central raised portion 22 of liner 20 is concave (as shown), such that a minimum vertical length of liner 20 exists in the middle of central opening 12 of top member 10. Accordingly, a needle, or other instrument used to puncture liner 20, passes through a liner thickness which is less than the total thickness of top member 10.

The interference mating of central raised portion 22 and center opening 12 of cap closure 1 of the present invention overcomes problems associated with conventional cap closures. Central raised portion 22 is not as likely to collapse into the container upon pressure from a needle. The interference fit also prevents liner 20 from falling out of cap closure 1 after assembly such that the cap closure and liner need not be reassembled when the containers are ready for sealing. The assembly may be accomplished manually or by machine preassembly. In addition, the small mass and absence of projections of liner 20 reduces the likelihood of contamination from the surrounding environment as well as from the container contents to cap closure 1.

While this invention has been disclosed with reference to specific embodiments, it is apparent that other embodiments and equivalent variations of this invention may be devised by those skilled in the art without departing from the true spirit and scope of this invention. The appended claims are intended to be construed to include all such embodiments and equivalent variations.

What is claimed is:

1. A cap closure comprising a top member with a center opening, said center opening having a diameter and an opening sidewall surrounding said opening, a dependent skirt for engaging a neck finish of a container, and a liner underlying said top member, said liner having an outer surface, said outer surface having a central raised portion with a central raised portion diameter surrounded by a central raised portion sidewall, the diameter of said central raised portion being at least at one point, greater than the smallest center opening diameter of said top member, wherein said central raised portion sidewall is straight and said center opening sidewall has an outward flare and the height of said central raised portion sidewall is no greater than that of said opening sidewall, said opening sidewall and said central raised portion sidewall adapted to mate with one another with an interference fit therebetween.

2. A cap closure comprising a top member with a center opening, said center opening having a diameter and an opening sidewall surrounding said opening, a dependent skirt for engaging a neck finish of a container, and a liner underlying said top member, said liner having an outer surface, said outer surface having a central raised portion with a central raised portion diameter surrounded by a central raised portion sidewall, the diameter of said central raised portion being at least at one point, greater than the smallest center opening diameter of said top member, wherein said central raised portion sidewall and said center opening sidewall are both outwardly flared and the height of said central raised portion sidewall is no greater than that of said opening sidewall, said opening sidewall and said central raised portion sidewall adapted to mate with one another with an interference fit therebetween.

3. A cap closure, as recited in claim 1 or claim 2, wherein said outer surface of said central raised portion is concave.

* * * * *